United States Patent [19]

Lorenz et al.

[11] Patent Number: 4,910,388

[45] Date of Patent: Mar. 20, 1990

[54] ELECTRIC HEATING UNIT

[75] Inventors: Josef Lorenz; Robert Kicherer, both of Oberderdingen; Ewald Keller, Zaberfeld, all of Fed. Rep. of Germany

[73] Assignee: E.G.O. Elektro-Gerate Blanc u. Fischer, Fed. Rep. of Germany

[21] Appl. No.: 217,569

[22] Filed: Jul. 11, 1988

[30] Foreign Application Priority Data

Jul. 15, 1987 [DE] Fed. Rep. of Germany ..... 3723345

[51] Int. Cl.[4] ..... H05B 3/34

[52] U.S. Cl. ..... 219/543

[58] Field of Search ..... 219/203, 543

[56] References Cited

U.S. PATENT DOCUMENTS

| | | | |
|---|---|---|---|
| 2,391,382 | 12/1945 | Bilan | 219/544 |
| 3,475,588 | 10/1969 | McMaster | 219/543 X |
| 3,757,087 | 9/1973 | Bernard | 219/549 |
| 3,869,596 | 3/1975 | Howie | 219/543 X |
| 3,982,092 | 9/1976 | Marriott | 219/543 X |
| 4,251,712 | 2/1981 | Parr | 219/203 |
| 4,450,346 | 5/1984 | Boaz | 219/203 X |
| 4,488,033 | 12/1984 | Trachtenberg | 219/203 X |
| 4,628,187 | 12/1986 | Sekiguchi et al. | 219/543 X |

FOREIGN PATENT DOCUMENTS

| | | | |
|---|---|---|---|
| 1957768 | 10/1971 | Fed. Rep. of Germany . | |
| 2052224 | 1/1981 | United Kingdom | 219/203 |

*Primary Examiner*—Donald A. Griffin

*Attorney, Agent, or Firm*—Steele, Gould & Fried

[57] ABSTRACT

In an electric heating unit (1), at least one heating circuit of a heating resistor (2) is arranged as a coated or printed conductor track and is consequently arranged by means of an adhesive joint (16) on a support (3) made from a high temperature-resistant synthetic paper. The unit is fixed, on its bare side remote from the heating resistor and by means of a whole-surface adhesive joint (13), directly to the associated reception side (11) of the body (10) to be heated. The adhesive joint (13) is appropriately formed by an adhesive layer (14) of silicone resin adhesive or the like, or a self-adhesive layer with a thickness of a few tenths of a millimeter and which permanently in stress-compensating manner has roughly the same thermal stability as the support (3). At least one heating circuit can be switched by means of a mechanical temperature switch with high switching hysteresis.

36 Claims, 3 Drawing Sheets

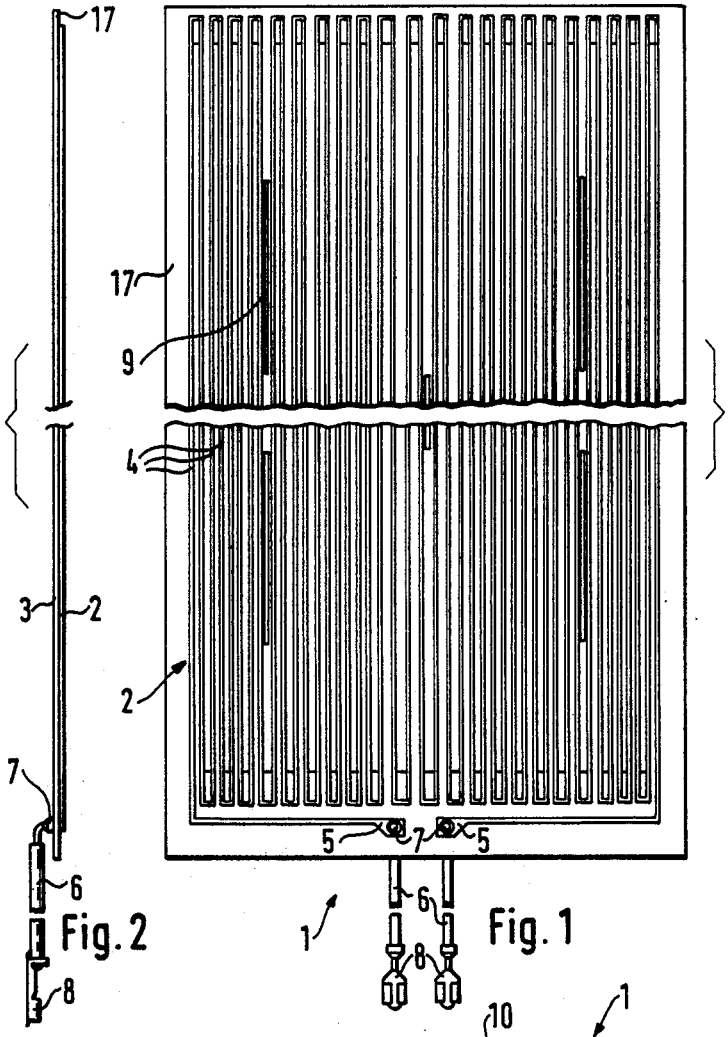
Fig. 2
Fig. 1
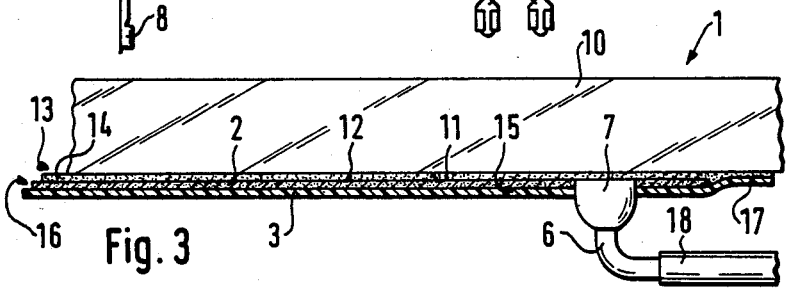
Fig. 3

ELECTRIC HEATING UNIT

BACKGROUND OF THE INVENTION

1. Field of the Invention

The invention relates to an electric heating unit for a body to be heated with a support and an e.g. flat layer-like electric heating resistor arranged thereon.

2. Prior Art

Attempts have already been made in connection with heating units in this field to arrange the heating resistor between polyamide films or sheets and in this way to apply same as a multilayer constructional unit to the plate to be heated. However, it has been found that this construction leads to relatively complicated processing and also the stresses which occur, particularly those of a thermal nature, are not always adequately withstood. However, these and other constructions often also suffer from the disadvantage that they are only suitable for relatively low limiting temperatures of e.g. up to 80° C. or slightly above the same. A prefabricated film layer is positioned between the heating resistor and the plate to be heated, and this impairs both the thermal stability of the union with the heating plate and also the thermal coupling of the heating resistor, as well as the compactness of the complete heating unit.

SUMMARY OF THE INVENTION

An object of the present invention is to provide an electric heating unit of the aforementioned type which, in the case of simple construction and high thermal rating or temperature load capacity, ensures an uncomplicated fitting of the heating resistor within the heating unit.

According to the invention this object is achieved in that the support is at least partly formed by a paper-like substrate which, by coating, forms a unit with at least one heating resistor. As opposed to an etched-in heating conductor track, in the case of such an arrangement it is possible to ensure a much higher thermal stability, despite simpler manufacture. In addition, the heating resistor can be applied in the manner of a thick layer with a much greater material thickness, so that higher heating capacities can be obtained.

The electric heating unit can be used for the most varied bodies to be heated, e.g. for flat bodies, such as heating plates, plate glass panes, mirror glasses and the like. Appropriately at least one heating resistor with the associated support forms a closed subassembly in the form of a heating device, the support receiving the flat layer-like heating resistor on one reception side and the heating resistor forming a heating resistor surface remote from said reception side. Before the heating device is fitted, the reception side can form a bare, exposed, metallic surface in the associated constructional unit. It is particularly advantageous if the heating device has on its side associated with the heating resistor surface an at least part-surface adhesive joint for direct connection with an opposite or mating surface intended for the mounting of the heating device and which can either be directly formed by a surface of the body to be heated or, in certain cased, also by a surface remote therefrom. At the latest following fitting or installation, the heating resistor surface is merely covered by said opposite surface or by the adhesive joint and is consequently protected and/or electrically insulated. As a function of the particular requirements, the adhesive joint can also be provided in whole-surface manner, so that it covers both the entire heating resistor surface and the associated support surface.

The adhesive joint can optionally be formed by an adhesive layer which only completely hardens during the fixing of the heating resistor and which is e.g. previously applied in plastic or liquid manner, so that following the joining of the heating resistor and the body to be heated only said single adhesive joint layer is provided between these parts. According to a preferred construction the adhesive joint is formed by an adhesive layer which can have a relatively small layer thickness of e.g. at most the thickness of the heating resistor or less, although for certain uses it can be advantageous to have a thickness greater than that of the heating resistor.

It is conceivable for the adhesive layer to be formed by a two-component adhesive. It is advantageous if the adhesive joint retains a certain permanent elasticity, so that it is possible to automatically compensate in damage-free manner stresses in the joint between the heating device and the body to be heated.

A silicone or silicone resin adhesive is particularly suitable as the adhesive joint layer. In the case of such adhesives setting or hardening takes place by a chemical reaction with the atmospheric humidity and small amounts of acetic acid are released as a decomposition product. In order to achieve maximum thermal loadability of over 200° C., it is advantageous to subject the adhesive layer to a slowly rising temperature following complete curing. The inventive heating device, particularly in the case of such a construction, is stable with respect to permanent operating temperatures of over 100° C. and up to at least 150° C., short-term peak loads of up to approximately 300° C. being possible. It is particularly advantageous if the adhesive is applied by means of a viscous fluid directly to the heating resistor, as well as an underfilm optionally carrying the same, because it is then possible to achieve very small layer thicknesses and a very uniform distribution. The adhesive can e.g. be that known under the trade mark PACTAN, or an other adhesive which connects of joins in stress-compensating manner, has good and sealing characteristics, retains its elasticity, extensibility and notch toughness even in the case of high and low temperatures. The adhesive should be stable to water, steam, dilute acids, alkalis, saline solutions and ageing and free from embrittlement, while having good electrical insulating characteristics and finally on hardening the adhesive should have a low volume shrinkage of preferably below 5%.

According to a particularly advantageous further development of the invention the adhesive joint is formed by a preferably layer-like or film-like prefabricated self-adhesive layer, active on two or all its sides, and which can be e.g. be a transparent acrylate layer with a thickness of approximately 0.13 mm. Such an adhesive layer which, prior to application, can be provided on all sides with an easily removable protective covering, e.g. of siliconized paper, can have a thermal stability well above 100° C., e.g. up to at least 130° C. and can be easily adapted to the outer contour of the heating device or its support, or the body to be heated by cutting to size.

The surface of the heating resistor remote from the body to be heated can also be fixed by an adhesive joint to a suitable support, particularly the said back or underfilm, or through said adhesive connection to the carrier can form a closed, inseparable constructional unit.

A very advantageous and reliable connection can also be obtained in that the heating resistor is produced by coating, such as e.g. pressing on the associated reception side, so that the adhesion resulting from the pressure action in itself forms the adhesive joint. If the heating resistor is not directly pressed onto the body to be heated,then it appropriately forms with the support a pressed-on constructional unit, which can then be very easily fitted by means of the first-mentioned adhesive joint to the body to be heated. Otherwise, following the pressing on of the heating resistor, appropriately subsequently a subfilm is applied as a covering for the heating resistor. Following application as a layer, the heating resistor can e.g. be advantageously stabilized or cured in that it is burnt into the support at a temperature of approximately 200° C.

According to a particularly advantageous embodiment of the invention at least the reception side of the body to be heated is made from electrically insulating material, a ceramic material, particularly a glass ceramic material having proved to be particularly advantageous and the body to be heated is made in one-layer form from the same material over its entire cross-section or its entire plate thickness, although, as a function of the particular use, it would be conceivable to have a two or multi-layer construction of the actual body. The inventive heating plate is particularly suitable for hot plates intended to keep food hot in the domestic field, but also for curved constructions, such as are required on containers. An advantageous use is to prevent condensation on mirrors or keeping outside mirrors ice-free, by means of heating.

According to a further development of the invention the support is constituted by a material formed from a high temperature-resistant plastic, particularly a polymer, which is preferably made from individual particles in the manner of a synthetic paper, e.g. from a slurry, using a conventional paper making machine. If this raw material is strongly compressed, e.g. by calendering at high temperature, a very tough, tension-proof, tearing-resistant, not-readily flammable, self-quenching, non-melting and flexible sheet is obtained with a high permanent temperature stability of almost the same values as the adhesive joint or only slightly lower values, while having very good dielectric characteristics, low shrinkage at elevate temperatures, a high sealing action and very good chemical stability with respect to conventional solvents, resins and oils. The permanent temperature stability can e.g. be up to approximately 220° C. and, much as with the adhesive of the adhesive joint, it can also have a stability of above 300° C. in the case of brief peak loads.

The aforementioned favorable values can be obtained in particularly simple manner with low manufacturing costs if the support is made from an aromatic polyamide, such as is e.g. known under the name Aramid. It is also advantageous to use for the production of the support elongated or flat particles in the nature of fibers or flakes and a particularly advantageous union is obtained if not only uniform particles, but e.g. also both flakes and fibers are thoroughly mixed. It is also conceivable to form the support from two or more identical or different layers in the manner of a laminate so as to constitute a sandwich. For example, it is possible to position between two film layers of the aforementioned type, a further film layer of a homogeneous material, such as e.g. polyester. For example it is possible to use the paper known under the DUPONT trade mark NOMEX or that known under the Faserprodukte GmbH Lahnstein trade mark PRETEX. A paper-like material is also conceivable, in which the long-fiber pulp fibers are mixed with polyamide fibers combined with synthetic binders of the acrylate copolymer type. The flat article or web forming the support can be provided with a one or two-sided top coating.

These and other features of preferred further developments of the invention can be gathered from the claims, description and drawings, whereby the individual features can be realized singly or in the form of subcombinations in an embodiment of the invention and in other fields and can constitute advantageous, independently protectable constructions for which protection is here claimed.

BRIEF DESCRIPTION OF THE DRAWINGS

The invention is described in greater detail hereinafter relative to a non-limiting embodiment and the attached drawings, wherein show:

FIG. 1 is an electric heating device of an inventive heating unit in elevation.

FIG. 2 is a section through the heating device according to FIG. 1.

FIG. 3 is a detail of FIG. 2 on a larger scale and in conjunction with a body of the heating unit to be heated.

DETAILED DESCRIPTION OF THE PREFERRED EMBODIMENTS

Figure 4:
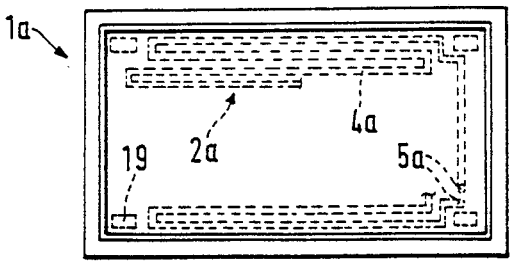
FIG. 4 is another embodiment of a heating unit in elevation.

FIGS. 1 to 3 show, by way of an example, a heating unit 1 according to the invention, with a heating device for a capacity of approximately 70 W under a voltage of approximately 220 V, which can be designed for a permanent operating temperature of approximately 130° C. and has edge dimensions of below 1 mm. In the represented embodiment heating unit 1 is shown in elevation in elongated rectangular manner with a longer edge dimension, which is e.g. approximately 30 cm and approximately twice as large as the smaller edge dimension.

The heating device has a flat layer-like heating resistor 2, which has a thickness of less than 1 mm or its thickness can be roughly 0.1 mm. Heating resistor 2 is preferably formed from a metal and/or graphite-containing paste, particularly a polymer paste and is laid in meandering manner in such a way that a plurality of parallel, juxtaposed, equal-length portions 4 are formed at a limited distance of only a few millimeters from one another. They are located parallel to the longitudinal edges of the heating device. The two outermost portions 4 have a distance from the associated longitudinal edges of a support 3, which is approximately two to three times greater than the spacing between the adjacent portions 4. Heating resistor 2 is appropriately formed from a polymer paste, which is applied in the manner of a printing process to the support 3 and thus forms a printed, electric conductor track. The two ends of said conductor track are oppositely directed with respect to one another adjacent and parallel to a narrow edge of the support 3 and form flat, enlarged connection ends 5 on the same side of support 3 as the side where the remainder of the heating resistor 2 is located.

Support 3 is formed by a paper-like, synthetic film or sheet with a thickness well below 1 mm, which together with the heating resistor 2 has a total thickness of only a few tenths of a millimeter, e.g. approximately or below 0.3 to 0.5 mm. On the associated side of the support 3 is applied the heating resistor 2 with its associated surface 15 located substantially in one plane or face, and by means of an adhesive joint 16 which, without additional adhesive, is formed directly by adhesion between the metal surface 15 and the associated side of support 3. In order to obtain particularly favorable characteristics the heating resistor 2 can be formed from a silver polymer paste or a mixture of a silver and a graphite polymer paste.

The other metal surface 12 of heating resistor 2, which is parallel to surface 15 and is also substantially located continuously in one plane or face, is free or exposed prior to arrangement on the body 10 to be heated, so that prior to installation the heating device need only comprise two layers, heating resistor 2 forming a boundary layer or interface. The heating device is then durably or non-detachably fixed by means of an adhesive joint 13 to the associated, smooth-surface or planar reception side of the body 10 to be heated by said surface 12 and uninterruptedly with the exposed parts of the associated surface of support 3 located between portions 4 of heating resistor 2.

Adhesive joint 13 is appropriately produced by using a separate adhesive in the form of an adhesive layer 14, whose thickness can be approximately the same as the total thickness of the heating device and consequently is only slightly larger or smaller or approximately the same as the thickness of the actual heating resistor 2. For producing the adhesive joint appropriately the film heating element or the heating device is coated on the associated side printed with the conductor track in an uninterrupted manner and over the entire extension thereof, whereby it can then be fitted to by applying to the dry, untreated reception side 11 of body 10. Following application, optionally pressing by levelling, rolling, flat contact pressure, etc. can be carried out. If use is made of an adhesive which hardens under atmospheric humidity, then this is appropriately applied in a thickness of approximately 0.3 mm and ensures that, despite a relatively good sealing of the support 3, the atmospheric humidity has a relatively uniform access to the hardening adhesive layer 14.

In order to assist this reaction process and to enable any air inclusions between the heating device and the body 10 to be heated to completely escape, the support 3 has a plurality of openings 9, which are appropriately arranged in such a way that they only pass through the support 3 in those areas where the heating resistor 2 is not located. The openings 9 are therefore appropriately in the form of slots running parallel to portions 4 and between the latter, whose longitudinal boundaries are appropriately at a limited distance from the associated heating resistor portions 4. Following the curing of the adhesive layer 14, openings 9 are not sealed by the layer 14 in such a way that the adjacent portions 4 of heating resistor 2 are covered in the manner of a seal.

The borders 17 which, in the vicinity of the edge associated with connecting ends 5, are roughly of the same width as in the vicinity of the longitudinal edges and on the edge facing the connecting ends 5 are much narrower, are adhesively fixed up to their marginal edges projecting over the heating resistor 2 to the reception side 11 of the body 10 to be heated and consequently form an all-round, ring seal-like closure, which is appropriately set back with respect to the associated outer edges of the body 10 to be heated. Thus, the heating resistor is permanently sealed in watertight manner with respect to the outside by embedding and is partly directly embedded in the adhesive layer 14, so that it is advantageously also protected against stray currents.

The ends of leads 6 are connected to the directly adjacent or facing connecting ends 5 of the heating resistor 2. These leads 6, which are appropriately made from a highly flexible material and which can e.g. be formed by copper-stranded wires, are supplied from the side of support 3 remote from the heating resistor 2 and transverse the same and the heating resistor 2 or its connecting ends 5 in the vicinity of openings, whose width exceeds the cross-section of leads 6. On said ends of leads 6 are provided connecting heads 7, which completely fill the said openings in the connecting ends 5 and support 3, are made from good electrically conducting material, e.g. a soldering material and terminate substantially flush on the surface 12 of the heating resistor 2, so that at the most they extend to said surface 12. However, it is also conceivable for the particular connecting head 7 to project in rivet head-like manner by a fraction of, e.g., 0.1 mm, beyond the surface and in particular maximum by the thickness of adhesive layer 16, so that said part can also be embedded in adhesive layer 14. In this case there is a direct adhesive connection of connecting head 7 or its associated end face with the adhesive layer 14, so that the connecting head 7 through the adhesive joint 13 is also directly fixed with respect to the reception side 11 of the body 10 to be heated and a high mechanical strength against tensile stresses of lead 6 is ensured. Connecting head 7, which can have roughly twice the diameter of lead 6, appropriately projects slightly beyond the side of support 3 remote from the heating resistor 2.

The particular lead 6 is appropriately provided with a flexible insulation 18, which only starts at a certain distance from support 3 or connecting head 7, so that between the insulation 18 and support 3 there is a short, exposed portion of lead 6. The insulation can be formed in that use is made of a siliconized copper-stranded wire. On the free ends of leads 6 are provided connecting elements 8, e.g. in the form of sockets, so that the heating device can be easily detachably electrically connected by means of plug connections.

In FIGS. 4 to 7 corresponding parts are given the same reference numerals as in the other drawings, but are followed by different letter references.

Figure 5:
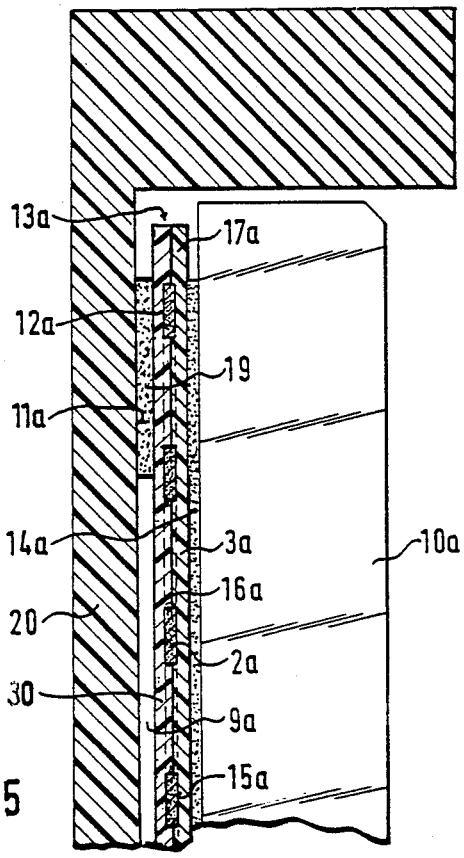
FIG. 5 is a detail of the heating unit according to FIG. 4 in a considerably enlarged cross-section.

In the case of the embodiment according to FIGS. 4 and 5, the heating unit constitutes a wall mirror for a wet or sanitary room, in which, such as e.g. in the case of a bathroom, the mirror can be exposed to such a high atmospheric humidity level, that it always has the tendency to mist over. The mirror glass forming the body 10*a* to be heated is arranged in a framelike member 20 made from plastic or some similar material with electrically insulating characteristics, which cover the entire back of body 10*a* and also engages round its outer border in circumferentially closed manner. In this case, in which electrical safety also plays an important part in the case of a breakage of body 10*a*, the support 17*a* is appropriately arranged as an additional electrical safety protective layer between heating resistor 2*a* and body 10*a*. The heating device with the heating resistor 2*a* remote from body 10*a* is advantageously directly adhesively fixed to a plate-like back part of member 20. At least the entire surface of support 3*a* receiving heating resistor 2*a* may be uninterruptedly and in moisture-tight manner so covered by a thin self-adhesive layer or preferably by a similar or equal layer as the support 3*a*, that the heating resistor 2*a* is embedded in the manner of a sandwich structure completely between support 3*a* and this over the entire surface adhesively attached layer 30.

The heating device is fixed to the basic member 20 in the case shown with an adhesive joint which is separate or spaced from the heating resistor 2*a* respective from the heated area and which although it can be formed by a whole-surface adhesive or self-adhesive layer, is appropriately formed by individual, small-surface, spaced, thicker adhesive joints 19, in such a way that the associated sides can always be exposed to ventilation. The adhesive joints 19 are e.g. four individual portions of self-adhesive layers located in the corner regions of body 10*a* or an imaginary polygon, adhesively fixed by one side directly to the side of support 3*a* associated to the heating resistor 2*a* respective to the additional layer 30 and with the other side directly to the front side of the basic member 20. Thus, the adhesive joints 19 also act in the manner of spacers, through which between the remaining support 3*a* and the said front side a gap 9*a* is left free for ventilation purposes. Also the circumferential edges of body 10*a* are spaced from member 20, so that there is a flue-like air guidance or circulation along the back of the heating device. As a result of the described construction the body 10 is exclusively fixed to the member 20 by its connection with the heating device or support 3*a*, so that there is no need for separate fastening elements directly connecting body 10*a* to member 20.

Figure 6:
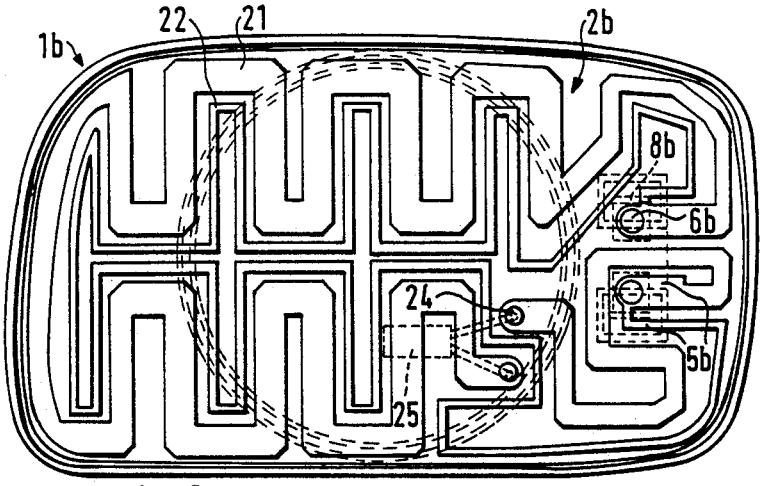
FIG. 6 Another embodiment of a heating unit in front view, but without the body to be heated.
Figure 8:
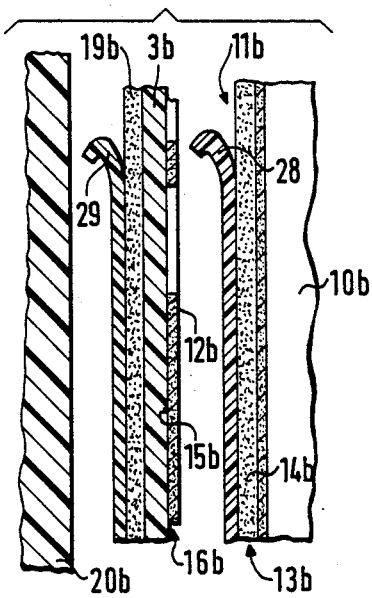
FIG. 8 A detail of FIG. 7 on a much larger scale.
Figure 7:
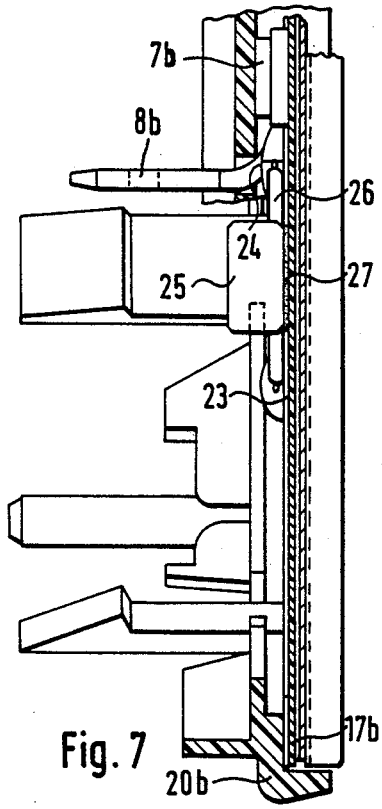
FIG. 7 A detail of the heating unit according to FIG. 6 in a greatly enlarged cross-section.

In the embodiment according to FIGS. 6 to 8 the heated object or the heating unit 1*b* is a car outside mirror, which is heatable for rapid de-icing purposes, heating in this case involving a voltage of e.g. 12 to 24 V.

The heating device, comprising at least one heating resistor 2*b*, support 3*b* and self-adhesive layer 19*b* and which is much thinner than the mirror glass 10*b*, is positioned between the latter and a base plate 20*b* receiving the same and which in turn for mirror setting purposes is adjustably secured in a mirror housing. The heating resistor 2*b* is located on the side of support 3*b* facing the mirror glass 10*b*, the self-adhesive layer 19*b* being positioned on the side remote therefrom. The adhesive joint 13*b* with respect to the mirror glass 10*b* is produced by means of self-adhesive layer 14*b*, which is initially applied to the mirror glass 10*b* or on its reflecting coating located on its back and to this extent constitutes a prefabricated subassembly with the mirror glass 10*b*. On its side remote from the mirror glass 10*b*, the contact-adhesive layer 14*b* is covered by a protective film 28. Following the removal of the latter, the heating device with surface 12*b* of heating resistor 2*b* is applied to the self-adhesive layer 14*b* and therefore to the mirror glass 10*b*. A protective film 29 initially covering the self-adhesive layer 19*b* on the side remote from the support 3*b* can also be removed, after which the self-adhesive layer 19*b* is adhesively joined to the base plate 20*b* and then the base plate 20*b* with mirror glass 10*b* and the heating device forms a closed, installable constructional unit. In the center the base plate 20*b* is provided with a large-area, substantially circular opening extending approximately to its longitudinal edges and in whose marginal region is provided a ring of fastening elements projecting over its back e.g. in the form of snapping elements constructed in one piece with the base plate. Appropriately the self-adhesive layer 19*b* is also provided in this area with an opening.

In the represented embodiment the heating resistor 2*b* forms at least two separate or substantially independent switchable heating circuits 21, 22, each of which is substantially uniformly distributed over the entire surface of the heating device or the mirror glass 10*b* in that the two heating circuits are laid within one another in meander-like manner. A heating circuit 21 with a higher or the highest heating capacity of over 25 or 30 watts, particularly approximately 35 watts, is formed by a strip-like, meandering coating, whose strip width is much larger than that of the lower capacity, other heating circuit 22. Heating circuit 21 passes in two parallel, meandering portions directly adjacent to the facing longitudinal edges of mirror glass 10*b*, while heating circuit 22 engages in the facing meandering openings of said two meandering portions with two parallel meandering portions and consequently has a slightly large spacing from said longitudinal edges of mirror glass 10*b*.

The ends of the two heating circuits 21, 22, which are produced by a one-part coating in a single operation, pass into one another pairwise for forming common connection ends 5*b* adjacent to one narrow side of the mirror glass 10*b*. An electrical connecting element 8*b* is electrically conductively connected to said ends 5*b* by a mechanical connection, namely by a rivet 7*b*. The shank of rivet 7*b* passes through the support 3*b* and the associated connection end 5*b* and has on the side of the heating resistor 2*b* remote from support 3*b* a layer-like, flat, disk-like rivet head with a thickness of 1 to a few tenths of a millimeter and is appropriately so pressed into the connection end 5*b* or support 3*b* that its surface remote from the heating resistor 2*b* is located at least approximately in the plane of the associated surface of the remaining heating resistor 2*b*. The other, much thicker rivet head engages on the side, remote from support 3*b*, of a leg of the angular connecting member 8*b*, said leg being supportable in whole-surface manner on the side of support 3*b* remote from heating resistor 2*b*. The other leg of the connecting member 8*b* projecting with respect to the back over the support 3*b*, forms an electrical plug in the form of a flat connecting tongue, which passes through an opening of base plate 20*b* adapted thereto and exposes a lead on its back for detachable connection with the mating connector.

In one heating circuit, appropriately in the higher capacity heating circuit 21, according to the invention a temperature switch 25 is appropriately provided which, compared with a PTC temperature monitor, can have a much higher thermal stability, particularly if it is constructed as a mechanical switch, e.g. as a bimetallic snap disk thermostat. This temperature switch 25 is fixed by a flat adhesive joint 27 within said opening in the self-adhesive layer 19*b* on the back of support 3*b* and e.g. has a flat casing, which is rectangular in elevation, which is only carried by support 3*b* parallel thereto, so that the temperature switch 25 forms a subassembly with the heating device. Adjacent to the connecting ends 5*b*, the heating circuit 21 is interrupted, so that it forms two further, spaced ends, which can be connected to the temperature switch 25 by means of two short, substantially linear leads, which are provided with insulating coverings. The substantially linear, relatively short leads 26, which are V-shaped with respect to one another and exclusively located on the back of support 3b can also be mechanically supporting parts for securing the temperature switch 25 with respect to support 3b.

Each of the further connecting ends of heating circuit 21 is appropriately traversed by an electric connecting element, which can be constructed as a rivet, particularly a hollow rivet and whose rivet head located on the heating resistor surface 12b is constructed in flat layer-like manner and arranged in countersunk form, as described relative to the rivet heads of connecting ends 5b. The end of the associated lead 26 is fixed to the other rivet head appropriately by a solder head 24.

After switching on the heating, e.g. with the aid of a manually operable switch, initially both heating circuits 21, 22 are operated in parallel, so that there is a heating capacity higher than 35 watt, e.g. between approximately 40 and 45 or more watt. The temperature switch 25 is set in such a way that it opens at a temperature between approximately 30° and 50° C., preferably approximately 40° C. and consequently switches off the heating circuit 21, while the heating circuit 22 continues to operate with a so-called inertia, which is appropriately below half the total capacity of the heating circuit 21, namely e.g. between approximately 7.5 and 11 watts. The switching hysteresis of temperature switch 25 is relatively high, namely over 15° to 25° C. and preferably approximately 30° C., so that the temperature switch 25 only switches in again on cooling to a temperature which is admittedly above freezing point, but is relatively close thereto, said switching-on temperature is appropriately approximately 10° C. As a result of the inertia, this temperature is conventionally maintained below the normally occurring external temperatures, so that temperature switch 25 is not switched in again and instead the heating circuit 21 is only switched in if the external mirror has cooled after a long period to below approximately 10° C. and therefore in a short time, namely within a few minutes, is to be heated to the operating temperature to be maintained by heating circuit 22. It has been found that as a result of the inventive construction said heating and therefore a complete thawing of the mirror can be achieved in roughly 7 minutes or less. This is in particular possible because the support has a thermal stability up to approximately 200° C., the temperature switch a thermal stability to well above 100° C. and the adhesive joints thermal stabilities up to approximately 130° C. or are operationally thermally stable up to these temperatures.

We claim:

1. An electrical heating unit for a body to be heated, said heating unit comprising:

a support made from an insulating material;

a heating resistor arranged on said support to form a unit, said heating resistor being made from a polymer paste constituting a compound layer of said support and containing graphite, wherein said support is at least partly formed by a paper-like particle-containing substrate, and said heating resistor contains a mixture of silver and graphite.

2. The heating unit according to claim 1, wherein said heating resistor is flat and layer-like, having a heating resistor surface, said support having a reception side connected to the heating resistor, said heating unit having on a surface including the heating resistor surface an at least part-surface adhesive joint for direct connection with a mating surface of said body to be heated.

3. The heating unit according to claims 1 or 2, comprising at least one adhesive joint on the heating unit substantially formed by an adhesive layer of at least substantially between 0.1 mm and 0.8 mm thickness.

4. The heating unit according to claim 1, further comprising at least one adhesive joint on the heating unit, at least partly formed by an adhesive hardening under atmospheric humidity.

5. The heating unit according to claim 1, further comprising at least one adhesive joint on the heating unit, formed by an at least 0.1 mm thick self-adhesive layer, thermally stable to substantially 130° C.

6. The heating unit according to claim 1, wherein only on a side remote from the body to be heated, the heating resistor is entirely covered by the support.

7. The heating unit according to claim 1, wherein said heating resistor has portions located adjacent to areas of said support, said areas of said support being fixed by an adhesive joint directly to a mating surface.

8. The heating unit according to claim 7, wherein said areas of said support are fixed directly to the mating surface by a same adhesive joint as said heating resistor.

9. The heating unit according to claim 1, wherein the heating device is fixed to the body to be heated by a single adhesive joint layer provided on a blank surface of the heating resistor and in substantially full-area manner on said support.

10. The heating unit according to claim 1, wherein an adhesive joint for the heating resistor is provided by a layer coated-on an associated surface and is connected as a printed conductor track to the support.

11. The heating unit according to claim 1, wherein the heating resistor is formed from a mixture of a silver and a graphite polymer paste.

12. The heating unit according to claim 1, wherein the heating resistor is stabilized by heat treatment and is burnt in at a temperature of approximately 200° C.

13. The heating unit according to claim 1, wherein at least a reception side of the body to be heated is formed from an electrically insulating hard material.

14. The heating unit according to claim 1, wherein the heating unit forms a three-layer sandwich plate with an adhesive layer, the heating resistor and the support, connecting heads for the heating resistor being incorporated in said sandwich plate.

15. The heating unit according to claim 1, wherein the support is substantially made from a non-melting, high temperature-resistant plastic.

16. The heating unit according to claim 15, wherein the support is made from an aromatic polymer in the manner of Aramid.

17. The heating unit according to claim 1, wherein the support comprises a paper-like material formed from a compressed mixture of fibers and flakes, including long pulp fibers, mixed with polyamide fibers combined with synthetic binders of the acrylate copolymer type and a top coating on both sides of the support.

18. The heating unit according to claim 1, wherein the body to be heated is a glass ceramic plate.

19. The heating unit according to claim 1, wherein the body to be heated is a mirror glass.

20. The heating unit according to claim 1, wherein the heating resistor is sealingly located between two substantially similar support layers.

21. The heating unit according to claim 1, wherein the support includes long-fiber pulp fibers.

22. The heating unit according to claim 1, wherein the support is a sandwich laminate of at least two layers, adjacent layers of the sandwich being made from the different materials.

23. The heating unit according to claim 1, wherein at least one adhesive joint is substantially formed by an adhesive layer between 0.1 mm and 0.5 mm thickness.

24. The heating unit according to claim 1, wherein the heating resistor has an adhesive joint provided with a layer pressed on to an associated surface and connected as a printed conductor track to the support.

25. The heating unit according to claim 1, wherein the heating resistor is stabilized by heat treatment and strengthened in connection to said support.

26. Any electrical heating unit for a body to be heated, said heating unit being a premanufactured assembly adapted for direct mounting to the body to be heated and comprising:

a support; and, a heating resistor arranged on said support, the support having outer boundaries, and within said outer boundaries said support has at least one venting opening forming an open through-opening extending through the electrical heating unit, the through-opening permitting escape of air during mounting of said heating unit on said body to be heated said at least one venting opening being located adjacent to the heating resistor and in at least one of said arrangements provided by a substantially parallel orientation of the venting opening to at least one adjacent portion of the heating resistor, and the location of the venting opening being between adjacent portions of the heating resistor.

27. The heating unit according to claim 26, wherein said through opening is one of a plurality of through openings substantially uniformly distributed over an area of said support.

28. The heating unit according to claim 26, wherein said through opening is one of a plurality of through openings located adjacent to the heating resistor, said through openings being located substantially parallel to adjacent portions of the heating resistor.

29. An electrical heating unit for a body to be heated, said heating unit comprising:

a support; and, a heating resistor arranged on said support, said heating resistor forming a prefabricated constructional unit with said support, and electric leads for said heating resistor, connecting heads of said leads passing through the support and defining free end faces, said constructional unit being adhesively fixed as an entity by means of an adhesive joint layer to the body to be heated, wherein said adhesive joint layer is provided on a surface including said end faces of said connecting heads.

30. An electrical heating unit for a body to be heated, said heating unit comprising:

a support; and, a heating resistor arranged on said support, wherein the heating device with the heating resistor remote from the body to be heated is provided laterally outside a heated field with part-surface adhesive joints, arranged in the manner of spacers, for fixing to a basic support surface and located on the side of the support remote from the body to be heated.

31. An electric heating unit for a body to be heated, said heating comprising:

a support; and, a heating resistor arranged on said support, wherein the heating resistor has at least two heating circuits distributed substantially over a same area to be heated, the at least two heating circuits having a substantially different rated capacity, at least one of the heating circuits being switchable independently from the other by means of a switch.

32. The heating unit according to claim 31, comprising at least one heating resistor, switchable by means of a mechanical temperature switch with a high switching hysteresis.

33. The heating unit according to claim 31, wherein said switch is fixed to a side of said support remote from said heating resistor.

34. The heating unit according to claim 31, wherein heating resistors of said two heating circuits provide contours with openings, one heating resistor engaging in the openings of the other heating resistor.

35. Any electrical heating unit for a body to be heated, said heating unit comprising:

a support; and, a heating resistor arranged on said support, and wherein the body to be heated is fixed to a basic support body member by an adhesive joint provided on the heating device, said basic support body member being adapted for supporting the body to be heated, said heating device constituting an intermediate bearing and support member for providing a sole support connection between the body to be heated and the basic support body member.

36. An electrical heating unit for a body to be heated, said heating unit comprising:

a support;

a heating resistor arranged on said support, and wherein ends of a layer providing said heating resistor form flat connecting ends, connecting heads penetrating said connecting ends and said support, and having terminal faces substantially entirely flush with an associated surface of said heating resistor and said connecting ends, said surface being remote from said support.

* * * * *